United States Patent [19]

Foster

[11] Patent Number: 4,525,928

[45] Date of Patent: Jul. 2, 1985

[54] BLADE OPENING SCABBARD FOR FOLDING KNIFE

[76] Inventor: John E. Foster, 10433 Malibu Ct., Baton Rouge, La. 70818

[21] Appl. No.: 530,407

[22] Filed: Sep. 8, 1983

[51] Int. Cl.[3] ..... B26B 29/02

[52] U.S. Cl. ..... 30/158; 224/232

[58] Field of Search ..... 30/151, 156, 158, 153, 30/159, 160, 231, 296 A; 224/232, 163

[56] References Cited

U.S. PATENT DOCUMENTS

| | | | |
|---|---|---|---|
| 616,689 | 12/1898 | Ruettgers | 30/158 |
| 689,513 | 12/1901 | Papendell | 30/158 |
| 847,474 | 3/1907 | Hawley | 30/158 |
| 2,250,290 | 7/1941 | Berg | 30/160 |
| 2,416,277 | 2/1947 | Siegel | 30/158 |
| 2,808,646 | 10/1957 | Lohr | 30/159 |
| 4,095,337 | 6/1978 | Pharr | 30/158 |
| 4,152,831 | 5/1979 | Davies | 30/231 |
| 4,389,775 | 6/1983 | Collins | 30/151 |
| 4,426,779 | 1/1984 | Morgan | 30/158 |
| 4,466,561 | 8/1984 | Slaughter | 224/232 |
| 4,494,309 | 1/1985 | Gray | 30/156 |

OTHER PUBLICATIONS

Advertisement-Gerber Legendary Blades.

*Primary Examiner*—Jimmy C. Peters
*Attorney, Agent, or Firm*—David L. Ray

[57] ABSTRACT

A scabbard for holding a knife having a folding blade, the scabbard having means therein for engaging thumb slits in the blade of the knife while the knife is being removed from the scabbard to enable the user of the knife to pivot the blade to the open position as the knife is being withdrawn from the scabbard. The means for engaging the thumb slits in the blade can be two pins mounted in the side of the scabbard or two longitudinal ridges or springs extending from the inner walls of the scabbard to engage a substantial length of the thumb slit in the blade of the knife. In one embodiment of the invention, the conventional thumb slits of a folding knife are extended to the end of the portion of the knife blade which first contacts the means for engaging the knife blade to enable the thumb slits to be engaged by the ridges, springs, or pins in the scabbard.

20 Claims, 7 Drawing Figures

BLADE OPENING SCABBARD FOR FOLDING KNIFE

BACKGROUND OF THE INVENTION

1. Field of the Invention

The present invention is related to folding knives, and in particular to a scabbard for a folding knife which enables the knife to be opened with one hand as the knife is withdrawn from the scabbard. 2. Description of the Prior Art While there are many disclosures in the prior art of folding knives designed to be easily and quickly opened, there has been no prior art found that discloses a scabbard which operates in conjunction with a knife to enable the user to withdraw the knife from the scabbard with one hand and simultaneously open the knife as it is being withdrawn. The following patents are exemplary of folding knives designed to be easily and readily opened.

U.S. Pat. No. 616,689 discloses a pocket knife having a folding blade with no thumb slits or notches therein. The blade is opened by means of a pivoted finger-piece.

U.S. Pat. No. 689,513 discloses a pocket knife having a folding blade with no thumb slits or notches therein which can be opened by a pivoted finger-piece at the end of the knife handle.

U.S. Pat. No. 847,474 discloses a pocket knife having a folding blade containing a lever for readily opening the blade without using the thumb nail. The lever is pivoted to the side of each of the blades near the tang and folds down by the side of the blade when not in use. The lever has a laterally projecting flange with which the ball of the thumb can be engaged when the blade is to be opened.

U.S. Pat. No. 2,416,277 discloses a pocket knife having a handle which contains a folding knife blade, and a member for engaging the folding knife blade and pivoting the knife blade to the open position. The member is pulled outwardly from one end of the knife to engage the folding blade in a rack and pinion arrangement which causes the blade to rotate from the folded position to the extended, or open, position.

U.S. Pat. No. 4,095,337 discloses a finger actuater for attachment to a conventional folding knife blade. The actuater is a resilient steel saddle arrangement fitted tightly over a knife blade which can be engaged by the thumb to open a blade while the other fingers of the hand hold the handle in the palm. The actuator enables the user to open the knife blade with one hand.

SUMMARY OF THE INVENTION

In accordance with the present invention there is provided a scabbard for holding a knife having a folding blade, the scabbard having means therein for engaging thumb slits in the blade of the knife while the knife is being removed from the scabbard to enable the user of the knife to pivot the blade to the open position as the knife is being withdrawn from the scabbard. The means for engaging the thumb slits in the blade can be two pins mounted in the side of the scabbard or two longitudinal ridges or springs extending from the inner side walls of the scabbard to engage a substantial length of the thumb slit in the blade of the knife. In one embodiment of the invention, the conventional thumb slits of a folding knife are extended to the end of the portion of the knife blade which first contacts the means for engaging the knife blade to enable the thumb slits to be engaged by the ridges or pins in the scabbard.

The scabbard of the present invention has many advantages over conventional scabbards which merely hold the knife on the belt or in the pocket of the user until the knife is ready for use. One of the major advantages of the present invention is that the user can withdraw a folding knife from the scabbard of the invention with one hand and simultaneously open the knife. Thus the hunter, fisherman, or other user of the knife can hold another object in one hand and withdraw his folding knife with the other hand for immediate use. In using the conventional scabbard, the knife must first be withdrawn from the scabbard and then opened with both hands, one hand being used to hold the knife handle and the other hand being used to pivot the blade to the open position.

Another advantage of the invention is that is securely holds the knife in a position on the belt of the user for immediate use while at the same time securing the knife to the belt of the user to prevent the knife from falling from the scabbard even when the user is engaged in strenuous physical activity such as climbing or running.

Another important advantage of the scabbard of the invention is that it permits a folding knife to be withdrawn by one hand ready for use similar to a knife with a straight blade while at the same time maintaining the advantages of the folding knife in safety and size. The folding knife is safer because the knife blade can be folded in the handle when not in use, whereas when a knife having a straight non-folding blade extending from the handle is not in its scabbard, the blade is exposed and can cut anything coming in contact with it. The folding knife is of course, much more compact and in general approximately half the length of a straight bladed knife.

DESCRIPTION OF THE PREFERRED EMBODIMENTS

Figure 1:
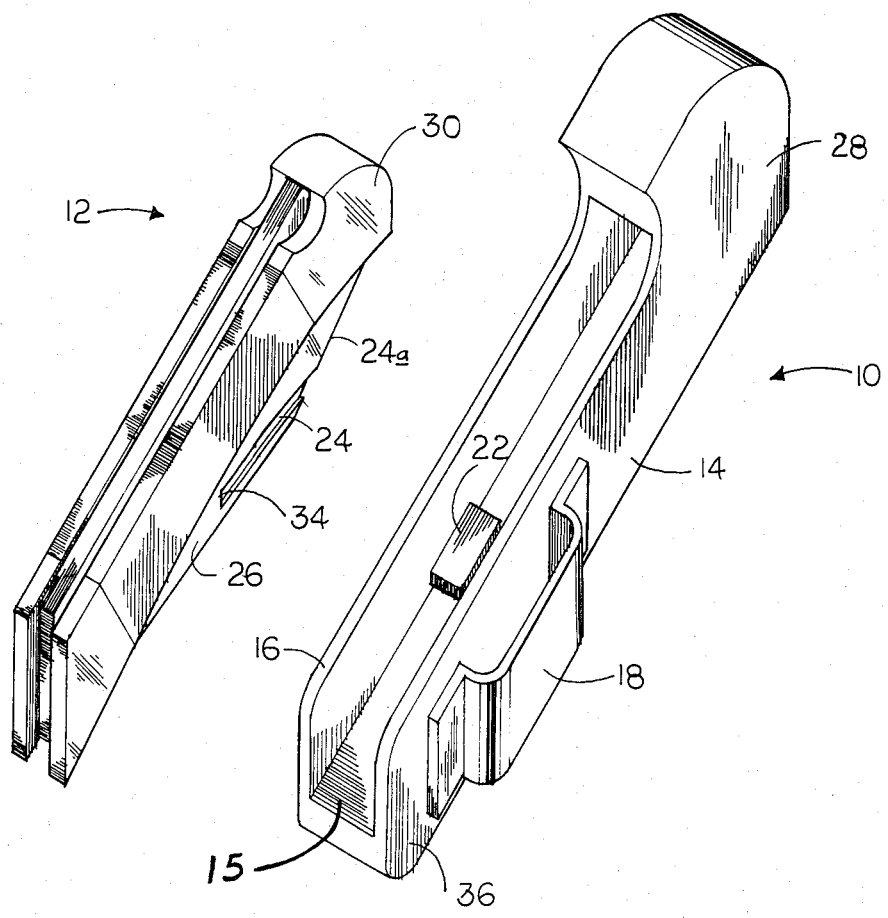
FIG. 1 is a perspective view of the scabbard of the invention and a foldable knife.
Figure 2:
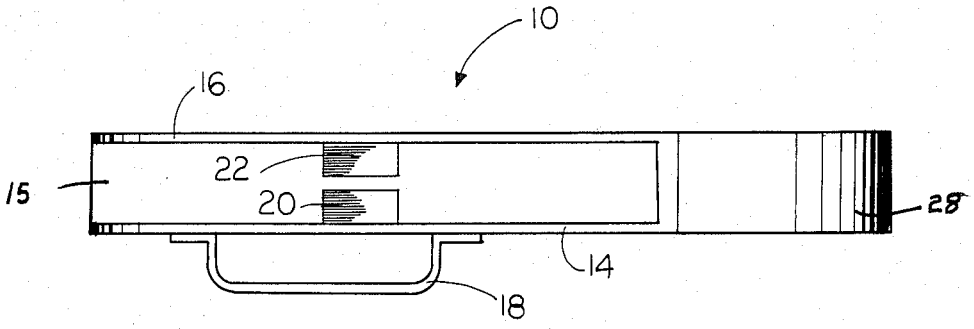
FIG. 2 is a top view of the scabbard of the invention.

Referring now to the drawings, and in particular to FIG. 1, the scabbard of the invention is generally indicated by the numeral 10 and a foldable knife is generally indicated by the numeral 12. Scabbard 10 can be seen to have two side walls 14 and 16 with a belt loop 18 being connected to sidewall 14. Side walls 14 and 16 are connected by base 15. Belt loop 18 receives the belt of the user and thereby secures the scabbard to the belt. Belt loop 18 may be mounted on the outside of either side wall 14 or 16 of the scabbard as desired for access by the right or left hand of the user. The location of the belt 18 on wall 14 is the preferred position of the belt loop when the scabbard is to be positioned on the right hand side of the user for knife withdrawal by the right hand of the user. However, if desired, the scabbard could be positioned on the belt on the user on the left hand side of the user for access by the left hand of the user.

Figure 3:
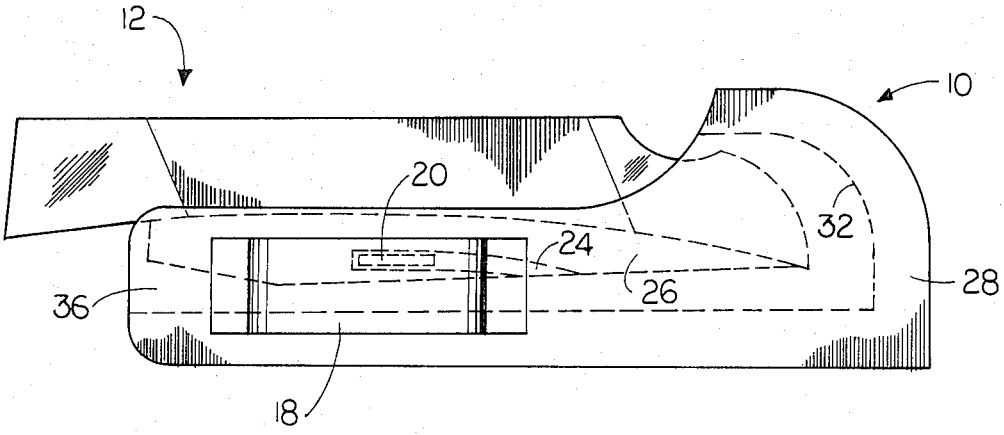
FIG. 3 is a side view of the scabbard containing the knife with the interior of the scabbard and the portion of the knife within the scabbard being shown in dotted lines.

Located on the interior of sidewalls 14 and 16 for engaging the thumb slit or notch 24 in knife blade 26 are ridges or protuberances 20 and 22. Ridges 20 and 22 are received in slot 24 as shown in FIG. 3 when the knife 12 is placed into scabbard 10. The lower end 28 of scabbard 10 is preferably closed so that the lower end 30 of knife 12 can rest against the lower interior wall 32 shown in FIG. 3. However, the ridges 20 and 22 can be positioned as shown in FIG. 3 to contact the end 34 of slit or notch 24 and blade 26 to limit the movement of knife 12 downwardly in scabbard 10 toward the lower end 28 of scabbard 10.

Figure 4:
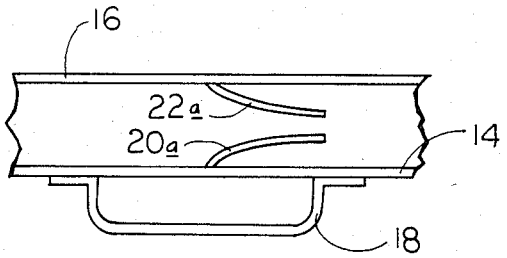
FIG. 4 is a partly cut-away top view of an addtional embodiment of the scabbard of the invention.

In FIG. 4 is shown an alternate embodiment of the invention wherein ridges 20 and 22 are replaced with springs 20*a* and 22*a* which are constructed from a flexible material, preferable spring steel. The springs 20*a* and 22*a* function similarly to ridges 22 and 20. Since springs 22*a* and 20*a* easily flex outwardly when blade 24 is inserted therebetween, it is not necessary that thumb slit or notch 24 extend completely to the top 24*a* of blade 26. Springs 20*a* and 22*a* may be made of any length necessary to engage the thumb slit or notch 24 in blade 26. The width of the springs 20*a* and 22*a* is slightly smaller than the width of notch 24 so that they may be easily received in thumb slit or notch 24.

Furthermore, if desired, the ridges 20 and 22 could be made of resilient material which would compress or flex sufficiently to enlarge the space between 20 and 22. Thus, a knife having a notch 24 therein which did not extend completely to the edge 24*a* of blade 26 could be utilized in a scabbard of the invention since the ridges 20 and 22 if flexible would compress or flex to allow an unnotched, thicker portion of the blade 26 to pass therebetween. Then, when the notch 24 was aligned with ridges 20 and 22, the ridges would snap into thumb slit or notch 24 to securely grasp the knife blade.

Figure 5:
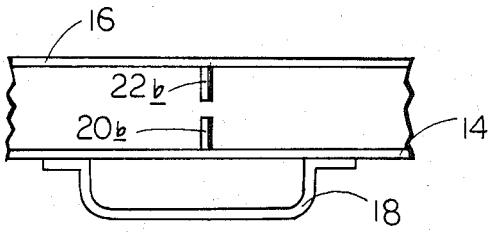
FIG. 5 is a partly cut-away top view of an additional embodiment of the scabbard of the invention.
Figure 6:
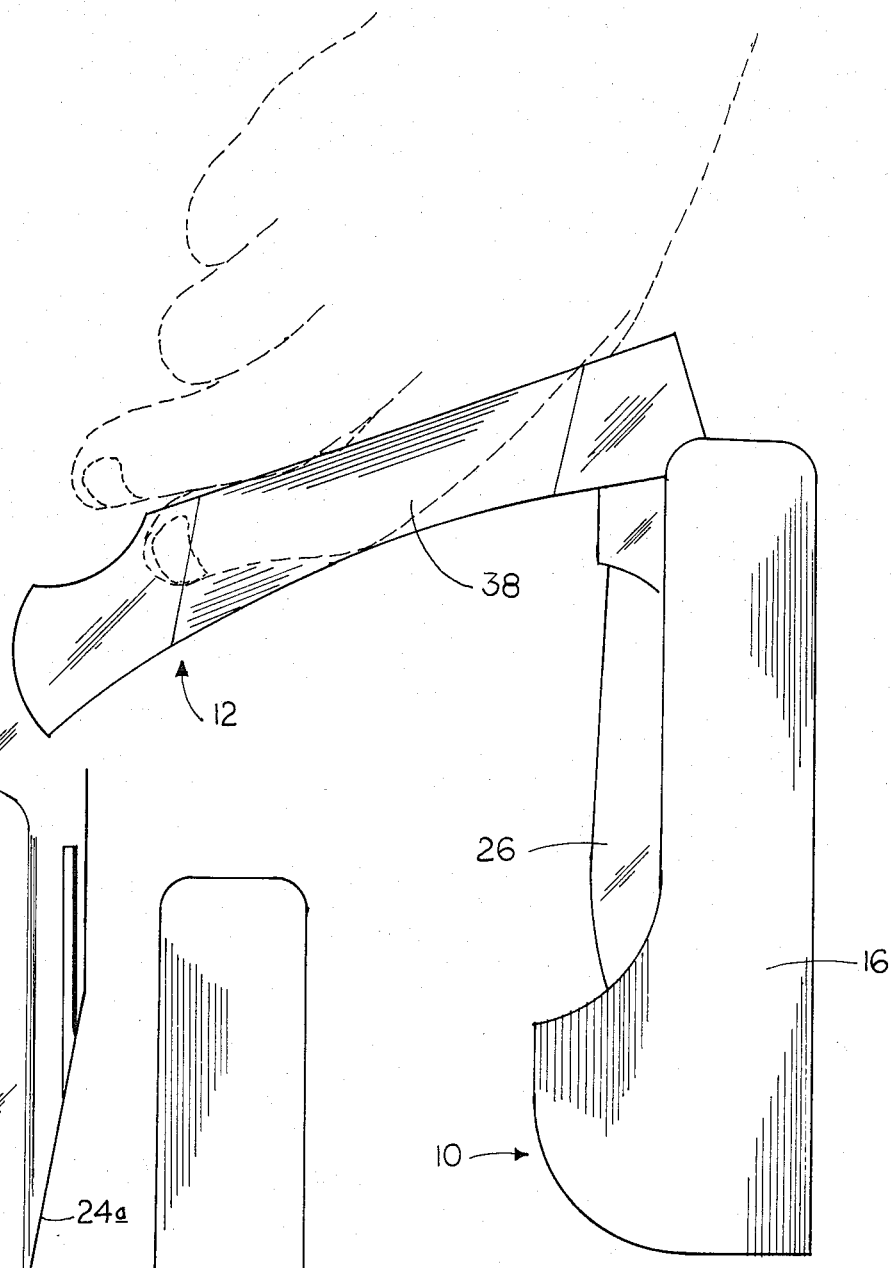
FIG. 6 is a side view of the scabbard of the invention showing the knife being grasped by the hand of the user and pivoted toward the open position as the knife is being withdrawn from the scabbard, the hand of the user being shown in dotted lines.
Figure 7:
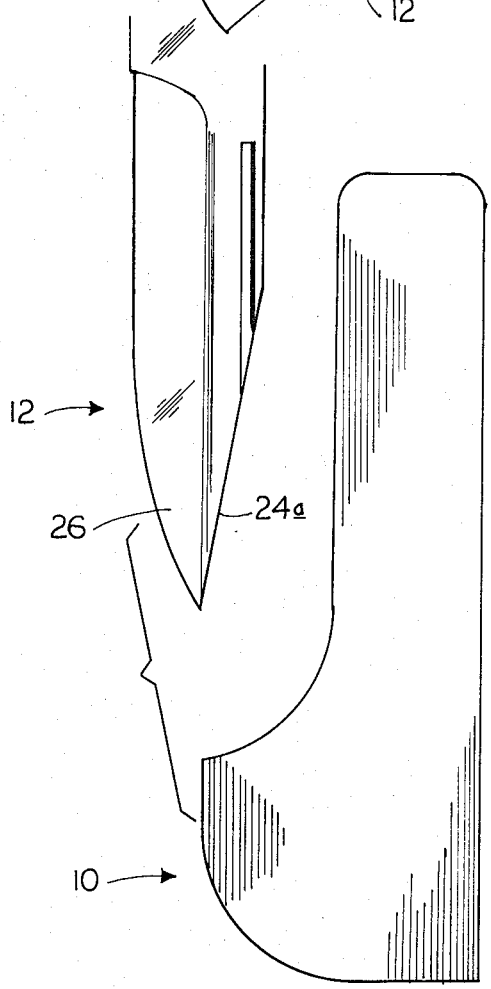
FIG. 7 is a side elevational view of the scabbard of the inventional and a portion of the knife blade withdrawn completely from the scabbard.

Furthermore, ridges 20 and 22 could be replaced by two cylindrical pins 20*b* and 22*b* as shown in FIG. 5. The diameter of the pins should be less than the width of notch 24. The pins could be rigid or flexible similarly to ridges 20 and 22.

The scabbard of the invention as can be seen in the drawings to be open at the top end 36 so that the knife may be easily aligned with ridges 10 and 22. The bottom end as previously mentioned is preferably closed but could be open if ridges 20 and 22, or pins 20*b* and 22*b*, are positioned or pins 20*b* and 22*b* so that they strike the end 34 of thumb slit or notch 24.

A preferred method of withdrawing the knife from scabbard 10 is shown in FIGS. 4 and 5. In these diagrams the scabbard of the invention is assumed to be located on the right hand side of the user with the lower end 28 pointed downwardly and the upper end 36 pointed upwardly. The side of the knife shown in FIG. 5 is grasped by the index finger 38, and on the other side, by the thumb of the right hand of the user. The thumb and index finger of the user then pivots away from the scabbard 10 causing the blade to pivot about the handle of the knife. As the knife is being opened it can be pulled upwardly to withdraw the knife from the scabbard 10. The knife thereby leaving the scabbard 10 as the blade reaches the fully opened position ready to use.

Scabbard 10 may be made from any material desired such as plastic, including thermosetting and thermoplastic polymers, metal such as aluminum, steel, brass and the like, and rigid animal skins such as hard leather, deer skin and the like. If the material from which walls 14 and 16 are made is selected to be sufficiently flexible, ridges 20 and 22 and pins 20*b* and 22*b* could be rigid and when a knife blade is inserted therebetween which has a thumb notch that does not extend to outer edge 24*a* of the knife blade, the walls would flex outwardly to allow the unnotched, thicker portion of the blade to pass therebetween and then close inwardly when ridges 20 and 22 or pins 20*b* and 22*b* are received within the notch.

Although the preferred embodiments of the present invention have been disclosed and described in detail above, it should be understood that the invention is in no sense limited thereby, and its scope is to be determined by that of the following claims.

What is claimed:

1. A knife and scabbard for holding said knife, said knife having a handle and a blade adapted to be pivoted into said handle, comprising holding means for holding said knife in position so that it can be grasped by the hand of the user, said scabbard having a top end and a bottom end, said top end being open and said bottom end being closed, said scabbard having knife blade holding means for holding said knife blade in said scabbard parallel to said scabbard as said handle is being pivoted about said knife blade and said blade is being withdrawn from said scabbard, said knife blade having slits therein for engaging said knife blade holding means.

2. The scabbard and knife of claim 1 wherein said knife blade has a pointed end, said pointed end of said blade being in said bottom end of said scabbard when said knife blade is received in said scabbard.

3. The scabbard and knife of claim 2 wherein said holding means for holding said knife blade comprises protuberances connected to the inside of said scabbard.

4. The scabbard and knife of claim 3 wherein said protuberances are adapted to be slidably received in said slits in said knife blade.

5. The scabbard and knife of claim 4 wherein said scabbard has two side walls for receiving said knife blade.

6. The scabbard and knife of claim 5, wherein said protuberances are connected to the inside of said side walls.

7. The scabbard and knife of claim 6 wherein said protuberances comprise pin means.

8. The scabbard and knife of claim 7 wherein said pin means are flexible.

9. The scabbard and knife of claim 6 wherein said protuberances comprise longitudinal ridge means.

10. The scabbard and knife of claim 9 wherein said longitudinal ridge means are flexible.

11. The scabbard and knife of claim 6 wherein said protuberances comprise spring means.

12. The scabbard and knife of claim 11 wherein said spring means comprise elongated spring members having two ends, one end being connected to the inside of said side walls.

13. The scabbard and knife of claim 6 wherein said side walls are flexible.

14. The scabbard and knife of claim 13 wherein said protuberances are rigid.

15. The scabbard and knife of claim 6 wherein said protuberances are flexible.

16. The scabbard and knife of claim 15 wherein said side walls are rigid.

17. The scabbard and knife of claim 5 wherein said side walls are connected together by base means.

18. The scabbard and knife of claim 6 wherein said slits extend parallel to said scabbard to the edge of said knife blade.

19. A knife and scabbard for holding said knife, said knife having a handle and a blade adapted to be pivoted into said handle, comprising holding means for holding said knife in position so that it can be grasped by the hand of the user, said scabbard having a top end and a bottom end, said top end being open and said bottom end being closed, said scabbard having a knife blade holding means for holding said knife blade in said scabbard parallel to said scabbard as said handle is being pivoted about said knife blade, and said blade is being withdrawn from said scabbard, said knife blade having slits therein for engaging said knife blade holding means, said slits extending longitudinally along said knife blade to the edge of said knife blade.

20. The scabbard and knife of claim 19 wherein said top end is adapted to receive the pointed end of said knife blade as said knife blade is inserted into said scabbard.

* * * * *